US005940904A

United States Patent [19]

Lutz

[11] Patent Number: 5,940,904

[45] Date of Patent: Aug. 24, 1999

[54] WATER MASSAGE DEVICE

[76] Inventor: Paul P. Lutz, 1926 W. Casino Rd., #M-104, Everett, Wash. 98204

[21] Appl. No.: 09/121,336

[22] Filed: Jul. 23, 1998

[51] Int. Cl.[6] ..... A61H 33/00

[52] U.S. Cl. ..... 4/559; 4/541.3

[58] Field of Search ..... 4/541.1–541.6, 4/492, 559; 607/81, 82, 85–87

[56] References Cited

U.S. PATENT DOCUMENTS

| | | | |
|---|---|---|---|
| 3,683,899 | 8/1972 | La Barber | 4/559 |
| 4,225,984 | 10/1980 | Lindsey | 4/541.3 |
| 4,430,762 | 2/1984 | Marshall | 4/541.5 |
| 4,872,224 | 10/1989 | Grimes et al. | 4/541.3 |
| 5,079,784 | 1/1992 | Rist et al. | 4/541.2 |
| 5,404,598 | 4/1995 | Hadsell | 4/541.4 |

*Primary Examiner*—Charles R. Eloshway

[57] ABSTRACT

A water massage device for mounting around the sides of a tub to provide a water massage to a user of the tub. The device includes an elongate conduit. A pump is fluidly connected to a first end of the conduit. The pump has an intake tube which has an inlet for drawing fluid into the pump. The pump is designed for pumping fluid from the intake tube into the interior of the conduit. The conduit has a plurality of spaced apart nozzles for spraying fluid therefrom.

11 Claims, 2 Drawing Sheets

WATER MASSAGE DEVICE

BACKGROUND OF THE INVENTION

1. Field of the Invention

The present invention relates to water massage devices and more particularly pertains to a new water massage device for mounting around the sides of a tub to provide a water massage to a user of the tub.

2. Description of the Prior Art

The use of water massage devices is known in the prior art. More specifically, water massage devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art water massage devices include U.S. Pat. No. 4,225,984; U.S. Pat. No. 3,802,422; U.S. Pat. No. Des. 288,607; U.S. Pat. No. 3,286,712; U.S. Pat. No. 4,872,224; and U.S. Pat. No. 4,207,877.

While these devices fulfill their respective, particular objectives and requirements, the aforementioned patents do not disclose a new water massage device. The inventive device includes an elongate conduit. A pump is fluidly connected to a first end of the conduit. The pump has an intake tube which has an inlet for drawing fluid into the pump. The pump is designed for pumping fluid from the intake tube into the interior of the conduit. The conduit has a plurality of spaced apart nozzles for spraying fluid therefrom.

In these respects, the water massage device according to the present invention substantially departs from the conventional concepts and designs of the prior art, and in so doing provides an apparatus primarily developed for the purpose of mounting around the sides of a tub to provide a water massage to a user of the tub.

SUMMARY OF THE INVENTION

In view of the foregoing disadvantages inherent in the known types of water massage devices now present in the prior art, the present invention provides a new water massage device construction wherein the same can be utilized for mounting around the sides of a tub to provide a water massage to a user of the tub.

The general purpose of the present invention, which will be described subsequently in greater detail, is to provide a new water massage device apparatus and method which has many of the advantages of the water massage devices mentioned heretofore and many novel features that result in a new water massage device which is not anticipated, rendered obvious, suggested, or even implied by any of the prior art water massage devices, either alone or in any combination thereof.

To attain this, the present invention generally comprises an elongate conduit. A pump is fluidly connected to a first end of the conduit. The pump has an intake tube has an inlet for drawing fluid into the pump. The pump is designed for pumping fluid from the intake tube into the interior of the conduit. The conduit has a plurality of spaced apart nozzles for spraying fluid therefrom.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new water massage device apparatus and method which has many of the advantages of the water massage devices mentioned heretofore and many novel features that result in a new water massage device which is not anticipated, rendered obvious, suggested, or even implied by any of the prior art water massage devices, either alone or in any combination thereof.

It is another object of the present invention to provide a new water massage device which may be easily and efficiently manufactured and marketed.

It is a further object of the present invention to provide a new water massage device which is of a durable and reliable construction.

An even further object of the present invention is to provide a new water massage device which is susceptible of a low cost of manufacture with regard to both materials and labor, and which accordingly is then susceptible of low prices of sale to the consuming public, thereby making such water massage device economically available to the buying public.

Still yet another object of the present invention is to provide a new water massage device which provides in the apparatuses and methods of the prior art some of the advantages thereof, while simultaneously overcoming some of the disadvantages normally associated therewith.

Still another object of the present invention is to provide a new water massage device for mounting around the sides of a tub to provide a water massage to a user of the tub.

Yet another object of the present invention is to provide a new water massage device which includes an elongate conduit. A pump is fluidly connected to a first end of the conduit. The pump has an intake tube has an inlet for drawing fluid into the pump. The pump is designed for pumping fluid from the intake tube into the interior of the conduit. The conduit has a plurality of spaced apart nozzles for spraying fluid therefrom.

Still yet another object of the present invention is to provide a new water massage device that is portable and quickly and easily mounted to a tub.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
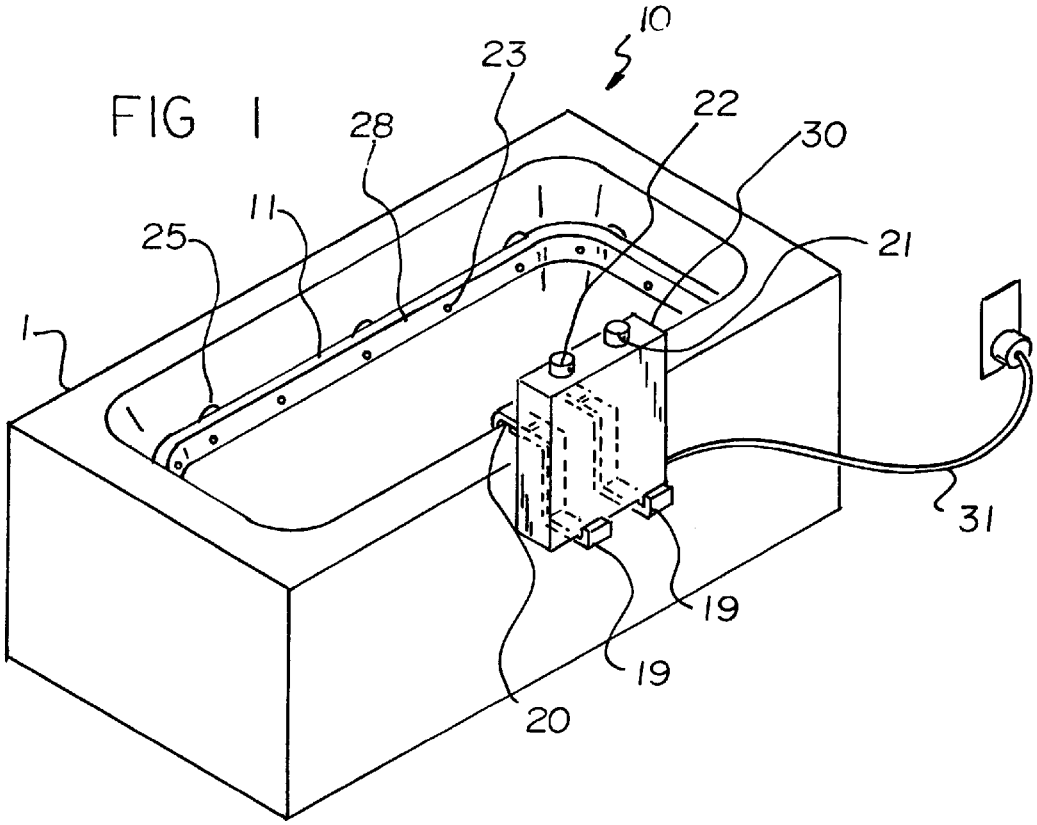
FIG. 1 is a schematic perspective view of a new water massage device according to the present invention.
Figure 2:
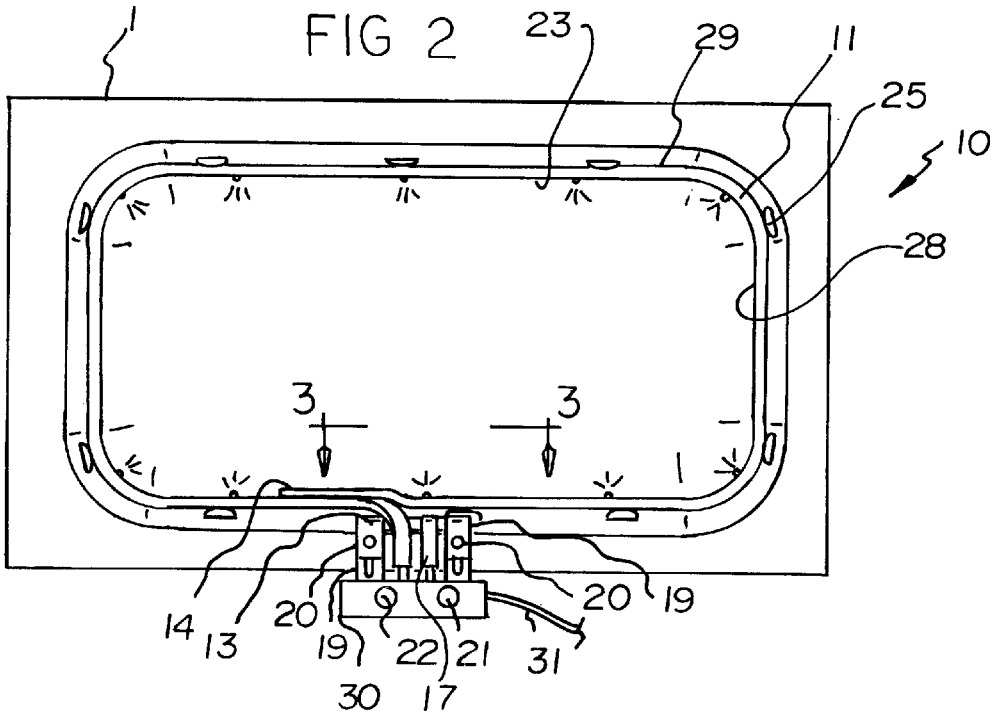
FIG. 2 is a schematic top view of the present invention.
Figure 3:
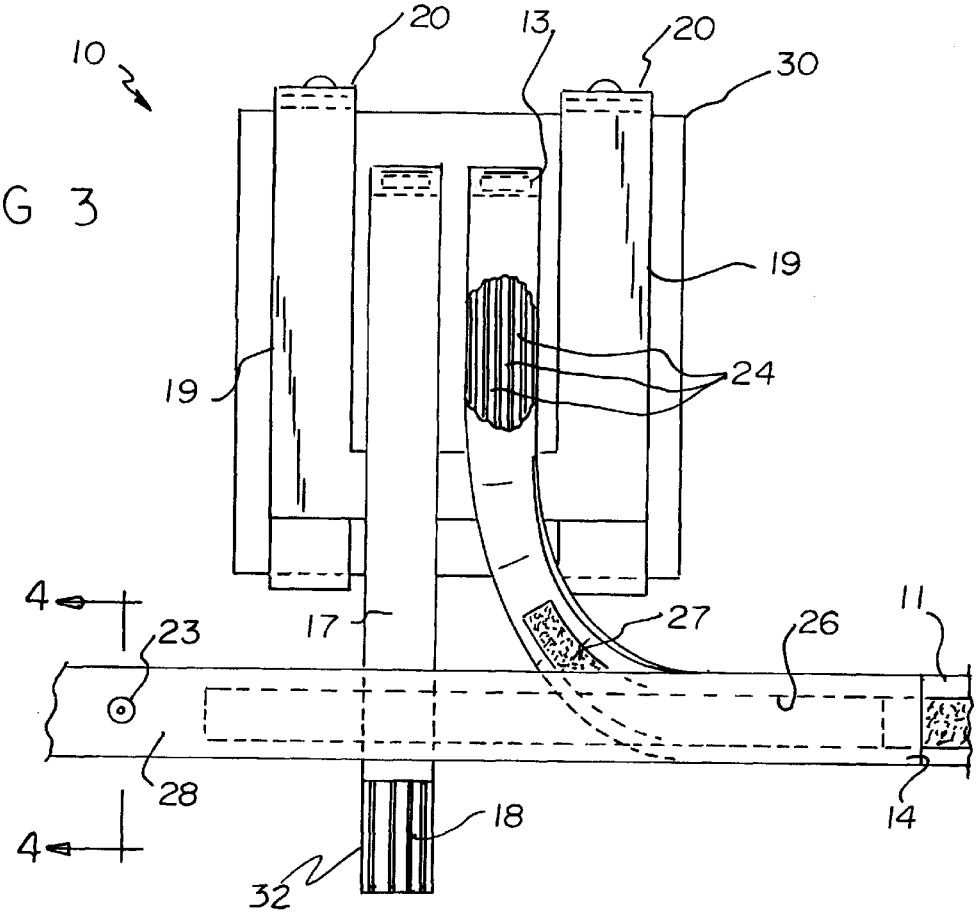
FIG. 3 is a schematic partial side view of the present invention taken from line 3—3 on FIG. 2.
Figure 5:
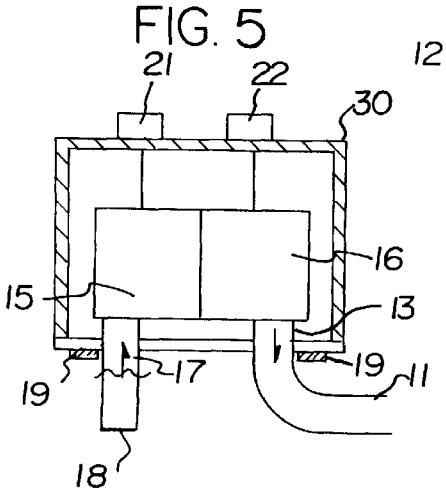
FIG. 5 is a schematic cross sectional view of the interior of the housing of the present invention.
Figure 4:
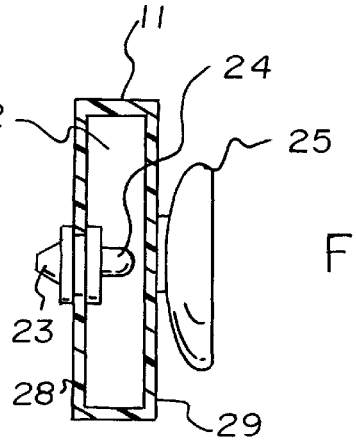
FIG. 4 is a schematic cross sectional view of the conduit of the present invention taken from line 4—4 of FIG. 3.

With reference now to the drawings, and in particular to FIGS. 1 through 5 thereof, a new water massage device embodying the principles and concepts of the present invention and generally designated by the reference numeral 10 will be described.

The water massage device for mounting to the sides of a tub 1. As best illustrated in FIGS. 1 through 5, the water massage device 10 generally comprises an elongate conduit 11. A pump 15 is fluidly connected to a first end 13 of the conduit 11. The pump 15 has an intake tube 17 has an inlet 18 for drawing fluid into the pump 15. The pump 15 is designed for pumping fluid from the intake tube 17 into the interior 12 of the conduit 11. The conduit 11 has a plurality of spaced apart nozzles 23 for spraying fluid therefrom.

In closer detail, a flexible elongate conduit 11 has an interior 12, opposite first and second ends 13,14, and a longitudinal axis extending between the first and second ends 13,14 of the conduit 11. Preferably, the conduit 11 has a generally rectangular cross-section taken generally perpendicular to the longitudinal axis of the conduit 11 so that the conduit 11 has opposite first and second sides 28,29 extending between the ends 13,14 of the conduit 11. In an ideal illustrative embodiment, the conduit 11 has a width defined between the first and second sides 28,29 of the conduit 11 of about ¼ inch.

The pump 15 is fluidly connected to the first end 13 of the conduit 11. The pump 15 has an intake tube 17 with an inlet 18 for drawing fluid in a tub 1 into the pump 15. The pump 15 is designed for pumping fluid from the intake tube 17 into the interior 12 of the conduit 11. The inlet 18 of the intake tube 17 preferably has a filter 32 for blocking passage of particles greater than a predetermined size therethrough into the intake tube 17. The pump 15 also preferably has a heater 16 for heating fluid pumped by the pump 15. The pump 15 and heater 16 is electrically connectable to an electrical outlet power source by an electric cord 31. The pump 15 has a pump controller 21 for controlling the pumping of fluid through the pump 15, in particular: the force and amount of fluid pumped by the pump 15. A heat controller 22 is also provided for controlling the temperature the heater 16 heats fluid pumped by the pump 15.

The pump 15, heater 16, and controllers 21,22 are preferably provided in a housing 30. The housing 30 is generally rectangular and has a pair of mounting brackets 19 adapted for mounting the housing 30 to the outside of a side of a tub 1 so that the inlet 18 of the intake tube 17 is positionable in the tub 1 to draw fluid in the tub 1 into the pump 15 when the housing 30 is mounted to the side of the tub 1. The mounting brackets 19 preferably each have an adjustably expandable mounting portion 20 for hanging over tub 1 sides of varying widths. Each of the controllers 21,22 has an actuator provided on the top of the housing 30 for permitting a user in the tub 1 to control the pump 15 and heater 16.

The conduit 11 has a plurality of spaced apart therapeutic spray nozzles 23 for spraying therefrom the fluid pumped into the conduit 11 by the pump 15. The nozzles 23 are arranged in a row extending between the first and second ends 13,14 of conduit 11 on the first side 28 of the conduit 11. The conduit 11 has a plurality of elongate tubes 24 in the interior 12 of the conduit 11. Each of the tubes 24 is associated with a nozzle 23 and has a pair of opposite ends. One end of the each of the tubes 24 is fluidly connected to the pump 15 to permit passage of fluid from the pump 15 into each of the tubes 24. The other end of each tube 24 is fluidly connected to the associated nozzle 23 to permit passage of fluid from the pump 15 through the tube and through the associated nozzle.

In use, the conduit 11 is designed for mounting around the inner sides of the tub 1 such that the longitudinal axis of the conduit 11 forms a ring. The conduit 11 preferably has a plurality of spaced apart suction cups 25 for detachably mounting the conduit 11 to the inner sides of the tub 1. The suction cups 25 are arrange in a row extending between the first and second ends 13,14 of the conduit 11 on the second side 29 of the conduit 11. In use, the second end 14 of the conduit 11 is detachably attachable to a portion of the conduit 11 adjacent the first end 13 of the conduit 11. Preferably, a fastener detachably attaches the second end 14 of the conduit 11 to the portion of the conduit 11. Ideally, the fastener comprises a hooks and loops fastener having a pair of complementary portions 26,27. One of the complementary portions 26 is provided on the second end 14 of the conduit 11 in a strip extending along the second side 29 of the conduit 11. The other complementary portion 27 is provided on the portion of the conduit 11 in a strip extending along the first side 28 of the conduit 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable water massage device for detachably mounting to the sidewall of an existing tub, said water massage device comprising:

an elongate flexible conduit adapted for detachably mounting to an inner surface of said sidewall, said conduit having an interior and opposite first and second ends, said second end of said conduit being closed and detachably overlapping a portion of said conduit adjacent said first end of said conduit;

a pump being fluidly connected to said first end of said conduit, said pump having an intake tube having an inlet for drawing fluid into said pump, said pump being for pumping fluid from said intake tube into said interior of said conduit;

said conduit having a plurality of spaced apart nozzles for spraying fluid therefrom;

said conduit having a plurality of elongate tubes in said interior of said conduit, each of said tubes being connected between said pump and an individual one of said plurality of nozzles for permitting passage of fluid from said pump to individual nozzles.

2. The water massage device of claim 1, wherein said conduit has a longitudinal axis extending between said first and second ends of said conduit, and wherein said conduit has a generally rectangular cross-section taken generally perpendicular to said longitudinal axis of said conduit.

3. The water massage device of claim 1, wherein said inlet of said intake tube has a filter for blocking passage of particles greater than a predetermined size therethrough into said intake tube.

4. The water massage device of claim 1, wherein said pump has a heater for heating fluid pumped by said pump.

5. The water massage device of claim 4, wherein said pump has a pump controller for controlling the pumping of fluid through said pump, wherein said pump has a heat controller for controlling the temperature said heater heats fluid pumped by said pump, wherein said pump, heater, and controllers are provided in a housing.

6. The water massage device of claim 5, wherein said housing has a pair of mounting brackets adapted for mounting said housing to the sidewall, said inlet of said intake tube being positionable in the tub to draw fluid in the tub into said pump when said housing is mounted to the sidewall.

7. The water massage device of claim 1, wherein said conduit has opposite first and second sides extending between said ends of said conduit, wherein said nozzles are arranged in a row extending between said first and second ends of said conduit on said first side of said conduit.

8. The water massage device of claim 7, wherein said conduit has a plurality of spaced apart suction cups for mounting said conduit to the inner sides of the tub, said suction cups being arranged in a row extending between said first and second ends of said conduit on said second side of said conduit.

9. The water massage device of claim 1, wherein said conduit has a plurality of spaced apart suction cups for mounting said conduit to the inner sides of the tub.

10. A water massage device for mounting to the sides of a tub, said water massage device comprising:

a flexible elongate conduit having an interior, opposite first and second ends, and a longitudinal axis extending between said first and second ends of said conduit;

wherein said conduit has a generally rectangular cross-section taken generally perpendicular to said longitudinal axis of said conduit, said conduit having opposite first and second sides extending between said ends of said conduit;

a pump being fluidly connected to said first end of said conduit, said pump having an intake tube having an inlet for drawing fluid into said pump, said pump being for pumping fluid from said intake tube into said interior of said conduit;

said inlet of said intake tube having a filter for blocking passage of particles greater than a predetermined size therethrough into said intake tube;

said pump having a heater for heating fluid pumped by said pump;

said pump having a pump controller for controlling the pumping of fluid through said pump, said pump having a heat controller for controlling the temperature heater heats fluid pumped by said pump;

said pump, heater, and controllers being provided in a housing, said housing being generally rectangular and having a pair of mounting brackets adapted for mounting said housing to a side of a tub, said inlet of said intake tube being positionable in the tub to draw fluid in the tub into said pump when said housing is mounted to the side of the tub;

each of said controllers having an actuator provided on said housing;

said conduit having a plurality of spaced apart nozzles for spraying fluid therefrom fluid, said nozzles being arranged in a row extending between said first and second ends of conduit on said first side of said conduit;

said conduit having a plurality of elongate tubes in said interior of said conduit, each of said tubes being associated with a nozzle and having a pair of opposite ends;

one end of said each of said tubes being fluidly connected to said pump to permit passage of fluid from said pump into each of said tubes;

another end of each of said tubes being fluidly connected to the associated nozzle to permit passage of fluid from said tube and through said associated nozzle;

said conduit being adapted for mounting around the inner sides of the tub, said conduit having a plurality of spaced apart suction cups for mounting said conduit to the inner sides of the tub, said suction cups being arranged in a row extending between said first and second ends of said conduit on said second side of said conduit; and said second end of said conduit being detachably attachable to a portion of said conduit adjacent said first end of said conduit, wherein a fastener detachably attaches said second end of said conduit to said portion of said conduit, wherein said fastener comprises a hook and loops fastener having a pair of complementary portions, one of said complementary portions being provided on said second end of said conduit, another of said complementary portions being provided on said portion of said conduit.

11. A portable water massage device for detachably mounting to the sidewall of an existing tub, said water massage device comprising:

an elongate conduit adapted for detachably mounting to an inner surface of said sidewall, said conduit having an interior and opposite first and second ends, said second end of said conduit detachably overlapping a portion of said conduit adjacent said first end of said conduit;

a pump being fluidly connected to said first end of said conduit, said pump having an intake tube having an inlet for drawing fluid into said pump, said pump being for pumping fluid from said intake tube into said interior of said conduit;

said conduit having a plurality of spaced apart nozzles for spraying fluid therefrom;

said conduit having a plurality of elongate tubes in said interior of said conduit, each of said tubes being connected between said pump and an individual one of said plurality of nozzles for permitting passage of fluid from said pump to individual nozzles; and a pair of mounting brackets for supporting said pump on the sidewall, each of said mounting brackets having an adjustably expandable mounting portion for permitting receipt of sidewalls of varying widths in said mounting brackets.

* * * * *